US007743777B2

(12) United States Patent
Gilman et al.

(10) Patent No.: US 7,743,777 B2
(45) Date of Patent: Jun. 29, 2010

(54) WATER VAPOR CLEANING SYSTEM

(76) Inventors: Vicki L. Gilman, 8105 Chiltern Ave., Las Vegas, NV (US) 89129; Brett D. Gilman, 8105 Chiltern Ave., Las Vegas, NV (US) 89129

( * ) Notice: Subject to any disclaimer, the term of this patent is extended or adjusted under 35 U.S.C. 154(b) by 948 days.

(21) Appl. No.: 11/503,704

(22) Filed: Aug. 14, 2006

(65) Prior Publication Data

US 2008/0035188 A1 Feb. 14, 2008

(51) Int. Cl.
*B08B 3/00* (2006.01)
*B08B 3/04* (2006.01)

(52) U.S. Cl. ..... 134/94.1; 134/198; 134/172; 134/102.1

(58) Field of Classification Search ..... 15/257.01, 15/246, 302, 314, 320, 321, 322; 134/53, 134/54, 102.1, 102.2, 172, 198, 94.1
See application file for complete search history.

(56) References Cited

U.S. PATENT DOCUMENTS 6,532,597 B2 * 3/2003 Bignon et al. ..... 2/161.6
6,640,383 B2 * 11/2003 Tsen ..... 15/321
6,877,183 B2 4/2005 Rosa
2002/0112744 A1 * 8/2002 Besseling ..... 134/30
2002/0144374 A1 * 10/2002 Tsen ..... 15/321

FOREIGN PATENT DOCUMENTS

EP 1561520 A2 * 8/2005
WO WO2006005373 A1 1/2006

OTHER PUBLICATIONS

Machine Translation of EP 1561520 A2 to Schroeder, Aug. 2005.*

* cited by examiner

*Primary Examiner*—Joseph L Perrin
*Assistant Examiner*—Benjamin Osterhout
(74) *Attorney, Agent, or Firm*—Dale J. Ream

(57) ABSTRACT

A water vapor cleaning system includes a vapor-producing chamber in communication with a water source, e.g. a hot water line, of an existing plumbing system. The vapor-producing device includes a vapor exit. The cleaning system includes a nozzle having an inlet, an outlet, and a valve selectively allowing or denying fluid communication between the inlet and outlet. The nozzle includes an actuator for selection between allowing or denying fluid communication. The nozzle is connected to the vapor-producing chamber with tubing. The nozzle also includes a vacuum device for suctioning items or blowing air through the tubing. A selector switch on the nozzle facilitates selection between steaming, vacuuming, blowing, soaping, and rinsing modes. A set of nozzle accessories are included for cleaning various types of surfaces.

6 Claims, 4 Drawing Sheets

WATER VAPOR CLEANING SYSTEM

BACKGROUND OF THE INVENTION

This invention relates generally to cleaning devices and, more particularly, to a vapor cleaning system connectible to an existing residential or commercial plumbing system for cleaning, sanitizing, and deodorizing a surface without using chemicals.

Steam cleaning is a very effective means for cleaning and the benefits are numerous. The concept of vapor cleaning is desirable in that non-planar surfaces and areas having obstructions are cleaned effectively with heated or highly pressurized water vapor. In other words, steam cleaning is an optimal choice on surfaces with cracks, crevices, and other hard to reach places. Another benefit is that steam cleaning can be done with very little moisture such that there are no watery messes left behind. Cleaning can be accomplished without buckets, mops, or gloves. Further, cleaning with steam avoids use of toxic chemicals and the resulting fumes, which are both significant health benefits and an economic savings.

Steam cleaners have traditionally involved an upright unit that may be pushed around a room or a floor unit that may be pulled to a desired location. These units also typically include a limited volume water reservoir that is filled prior to use. The intended purpose of these units is usually for the cleaning of floors or carpets. While assumably effective for their intended purposes, these devices are not effective for cleaning surface areas that have a variety of different surface types or areas not accessible to traditional steam cleaners.

Therefore, it would be desirable to have a water vapor cleaning system connectable to an existing water supply for cleaning selected surfaces using a limited volume of moisture, heat, and electricity and without using cleaning chemicals and without leaving a watery mess behind. Further, it would be desirable to have a water vapor cleaning system having interchangeable accessories for specifically cleaning different types of surfaces. In addition, it would be desirable to have a water vapor cleaning system that may be hand-held for comfortably cleaning surfaces in the proximity of a water supply, whether the system is connected to a kitchen sink, bathroom water supply, or commercial water supply.

SUMMARY OF THE INVENTION

Accordingly, a water vapor cleaning system according to the present invention includes a vapor producing chamber in fluid communication with a water source, such as a hot water line, in an existing plumbing system, the vapor producing chamber having a vapor exit. The water vapor cleaning system also includes a nozzle having an inlet and outlet, the nozzle inlet being operatively connected to the vapor producing chamber with tubing. A valve positioned in the nozzle allows communication between the inlet and outlet when set at a first configuration and prevents such communication when set at a second configuration. The nozzle includes an actuator for moving the valve between first and second configurations.

The water vapor system may also include a vacuum device connected to the tubing for suctioning items through or for blowing air out of the nozzle outlet. The nozzle includes a selector switch for choosing between a steaming mode, a vacuuming mode, a blowing mode, a soaping mode, and a rinsing mode. The nozzle may include a soap reservoir and water may be delivered by itself, e.g. hot water, with an appropriate mode selection since the system is connected to a water source. Several accessories are included for selective attachment to the nozzle and which are useful for cleaning different types of surfaces.

Therefore, a general object of this invention is to provide a water vapor cleaning system that is connectable to an existing residential or commercial plumbing system for conveniently cleaning a variety of surfaces using minimal moisture and heat.

Another object of this invention is to provide a water vapor cleaning system, as aforesaid, that may be permanently mounted beneath a sink yet be accessed from a countertop via a tubing and nozzle combination.

Still another object of this invention is to provide a water vapor cleaning system, as aforesaid, that may selectively vacuum small spills or dispense soap, hot water, dry air, or steam.

Yet another object of this invention is to provide a water vapor cleaning system, as aforesaid, having nozzle attachments suited for suitably cleaning various types of surfaces.

A further object of this invention is to provide a water vapor cleaning system, as aforesaid, for cleaning surfaces without the use of cleaning chemicals.

A still further object of this invention is to provide a water vapor cleaning system, as aforesaid, which includes a safety glove for preventing a user from being burned while dispensing hot water or steam.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
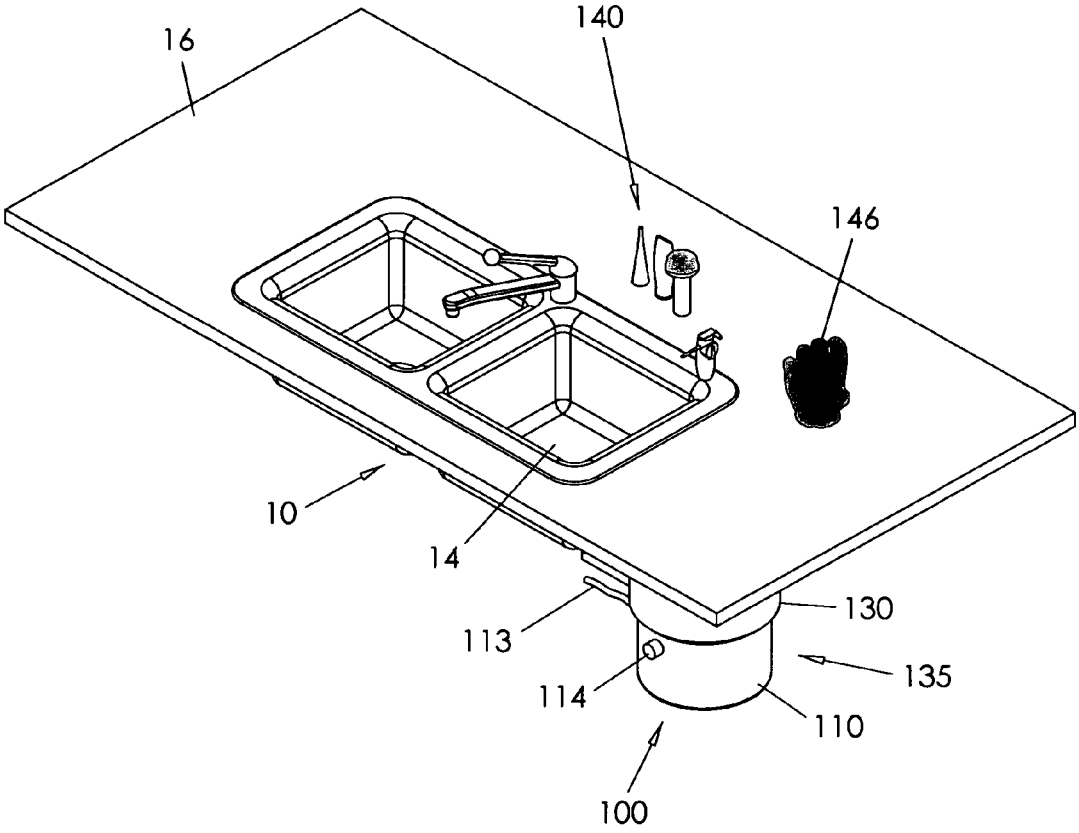
FIG. 1 is a perspective view of a water vapor cleaning system according to a preferred embodiment of the present invention installed for use with a kitchen sink.

A water vapor cleaning system 100 for use with an existing plumbing system 10 according to the present invention will now be described in detail with reference to FIGS. 1 through 4*d* of the accompanying drawings. The existing plumbing system 10 may include, for example, a water source 12 (e.g., a hot water line) and a sink basin 14 installed in a countertop 16, as shown in FIGS. 1 through 2*b*. A water vapor cleaning system 100 according to the current invention includes a vapor-producing chamber 110 and a nozzle 120.

Figure 2A:
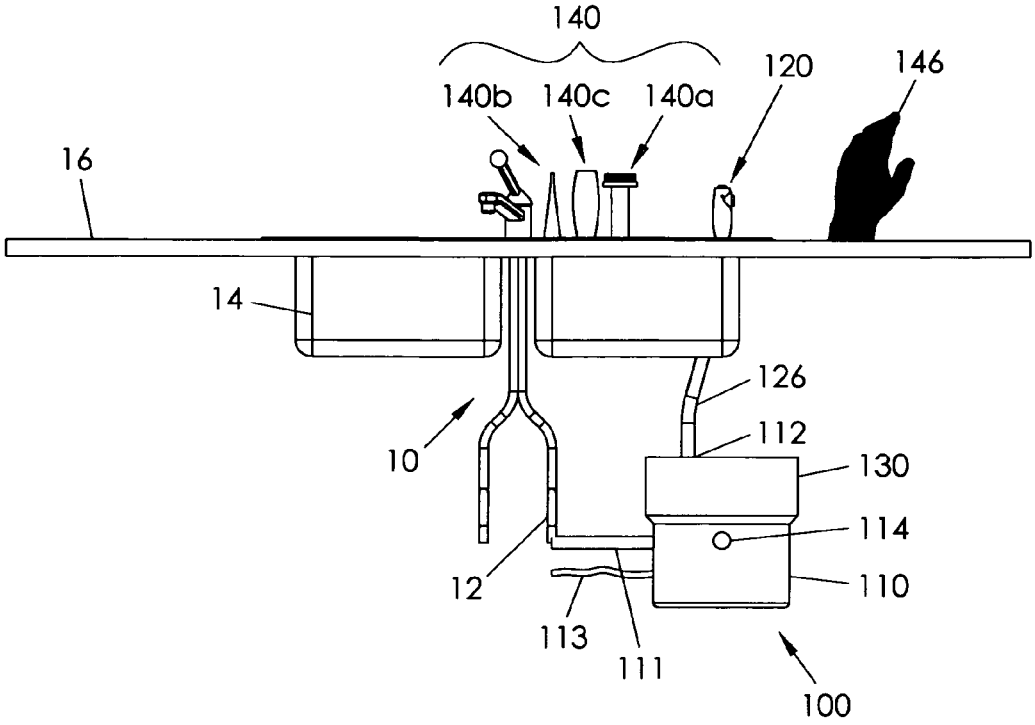
FIG. 2*a* is a front view of the cleaning system as in FIG. 1, illustrating connection with an existing plumbing system.
Figure 2B:
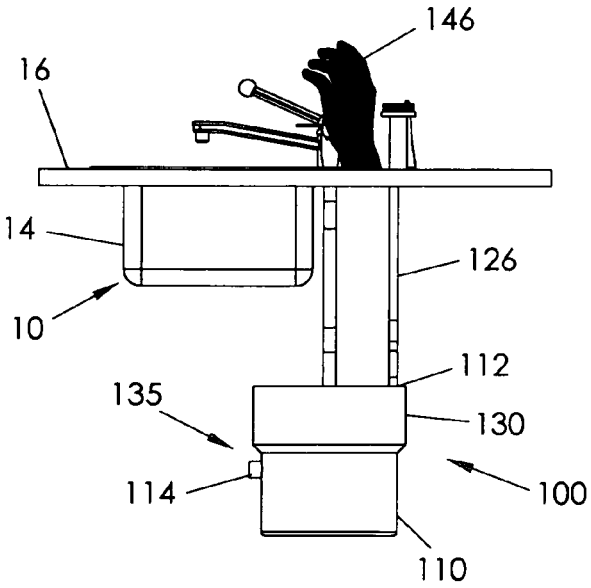
FIG. 2*b* is a side view of the cleaning system as in FIG. 2*a;*

The vapor-producing chamber 110 is in communication with the water source 12, such as through line 111 shown in FIG. 2*a*, and the vapor-producing chamber 110 has a vapor exit 112 (FIGS. 2*a* and 2*b*). The vapor-producing chamber 110 may produce vapor from water obtained from the water source 12 in various manners. For example, the chamber 110 may be in communication with a power source (e.g., through cord 113 shown in FIGS. 1 and 2*a*) and produce vapor using electrical resistance. The vapor-producing chamber 110 may include a pressure release valve 114 to relieve excess pressure inside the vapor-producing chamber as a safety feature, as shown in FIGS. 1 through 2*b*.

The nozzle 120 (FIGS. 4*a* through 4*d*) has an inlet 121, an outlet 122, and a valve allowing communication between the nozzle inlet 121 and the nozzle outlet 122 when at a first configuration and denying communication between the nozzle inlet 121 and the nozzle outlet 122 when at a second configuration. The valve may be, for example, a ball valve, or any other appropriate valve. An actuator 124 is coupled to the valve for moving the valve between the first and second configurations, and tubing 126 connects the vapor exit 112 with the nozzle inlet 121, as shown in FIGS. 2*a* and 2*b*. It should be understood that the tubing 126 has an elongate construction and may be pulled through a hole in the countertop when a user pulls on the nozzle 120. This allows the nozzle 120 to be used in cleaning surfaces in a relative proximity to the sink.

A vacuum device 130 may be coupled to the tubing 126 to selectively suction items through and blow air out the nozzle outlet 122, respectively. As shown in FIGS. 1 through 2*b*, the vacuum device 130 may be associated with the vapor-producing chamber 110 to form a single unit 135. Additionally, or alternately, means may be included for dispensing soap and/or water through the nozzle outlet 122. More particularly, the nozzle 120 may include soap in a soap reservoir, or the nozzle 120 may access soap in a soap reservoir in or coupled to the vapor-producing chamber 110. The nozzle 120 may access water from the water source 12 that has bypassed the vapor-producing chamber 110 or that is otherwise not vaporized by the vapor-producing chamber 110. The nozzle 120 may include a selector device 128 (FIG. 4*d*) for choosing between a steaming mode in which steam is passed through the nozzle outlet 122, a vacuuming mode in which items are suctioned in the nozzle outlet 122, a blowing mode in which air is blown out the nozzle outlet 122, a soaping mode in which soap is passed through the nozzle outlet 122, and/or a rinsing mode in which water is passed through the nozzle outlet 122, as appropriate.

Figure 3A:
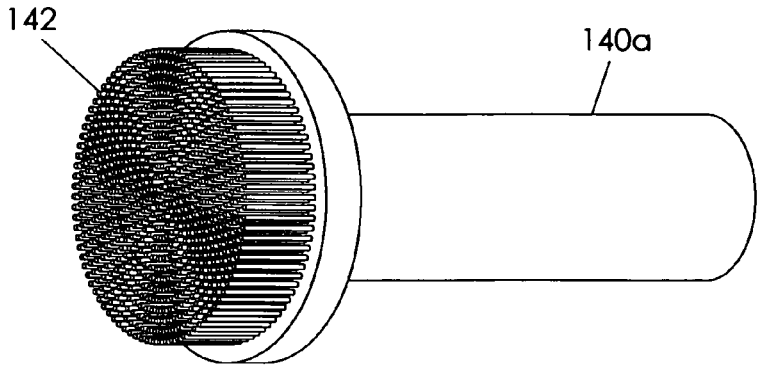
FIGS. 3*a* to 3*c* are perspective views of nozzle accessories for use with the cleaning system as in FIG. 1.
Figure 3B:
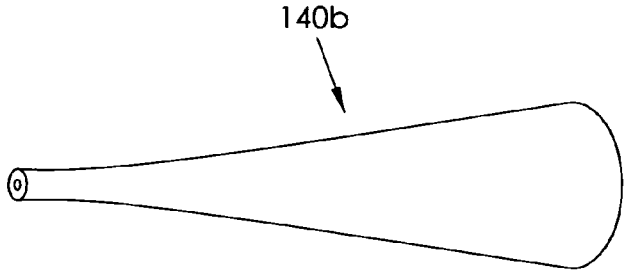
Figure 3C:
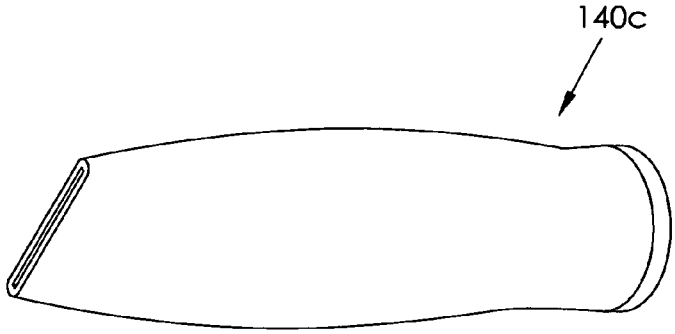
Figure 4A:
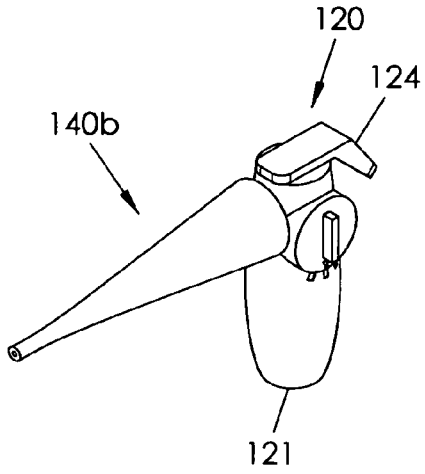
FIG. 4*a* is a perspective view of the nozzle as in FIG. 1 attached to a nozzle accessory.
Figure 4B:
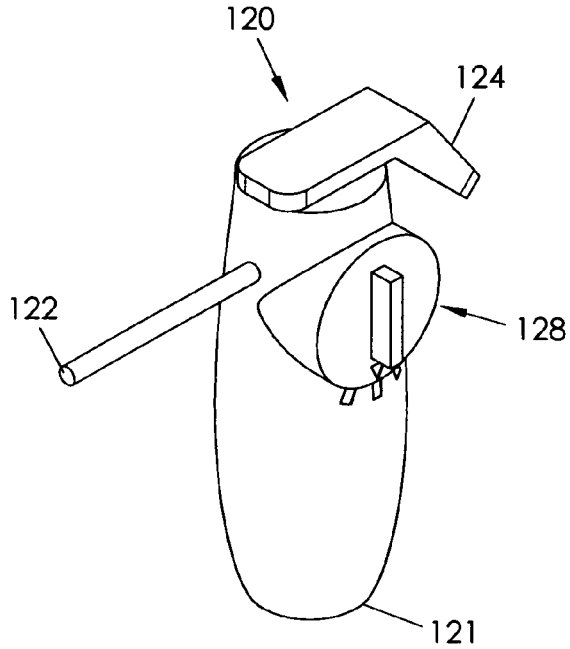
FIG. 4*b* is another perspective view of the nozzle as in FIG. 4*a* with the nozzle accessory removed.
Figure 4C:
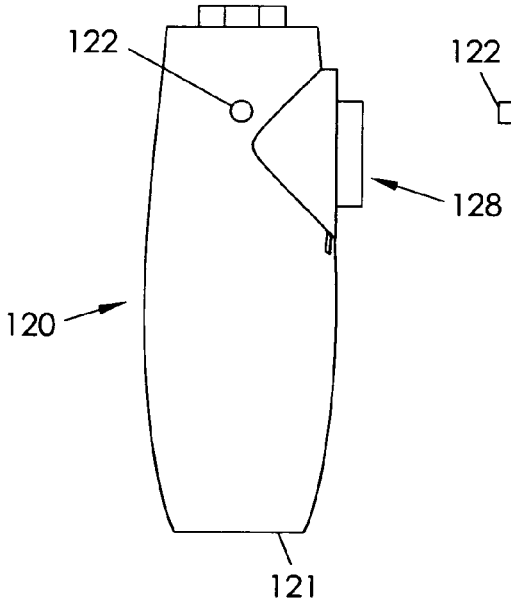
FIG. 4*c* is a rear view of the nozzle as in FIG. 4*a*.
Figure 4D:
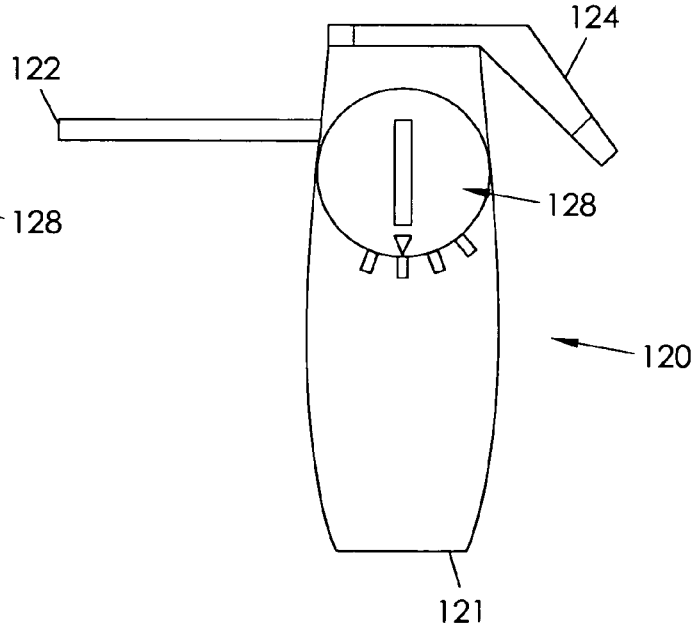
FIG. 4*d* is a side view of the nozzle as in FIG. 4*a*

One or more accessory, collectively referred to as 140, may be included. Each accessory 140 may be respectively attachable to the nozzle outlet 122 (FIG. 4*a*) to provide a unique spray characteristic. For example, the accessory 140*b* shown in FIG. 3*b* may provide a concentrated stream while the accessory 140*c* shown in FIG. 3*c* may provide an elongate stream. As shown in FIG. 3*a*, a respective accessory 140*a* may include a plurality of bristles 142. A safety glove 146 constructed of a heat resistant material (e.g., silicone) may be included to keep a user from being burned from vapor or hot water exiting the nozzle outlet 122 (FIGS. 2*a* and 2*b*).

In use, the vapor-producing chamber 110 and/or the vacuum device 130 may be installed beneath the countertop 16 (FIGS. 1 through 2*b*) so as to be generally out of view, and the tubing 126 may extend from beneath the countertop 16, through the countertop 16, and adjacent the sink basin 14 to be easily accessible. The nozzle 120 and tubing 126 may be pulled through the countertop 16 for use in proximity therewith. An accessory 140*b* may be attached to the nozzle outlet 122 (FIG. 4*a*), and the selector device 128 (FIG. 4*d*) may be used to choose between the steaming, vacuuming, blowing, soaping, and rinsing modes. Once the desired mode is chosen, the actuator 124 may be utilized to let the chosen element pass through the nozzle valve and the nozzle outlet 122. When the steaming mode is chosen, for example, vapor may pass through the tubing 126 and out the nozzle outlet 122 and the accessory 140*b* for use in cleaning non-planar surfaces and/or areas having obstructions that are not otherwise easily cleaned. The safety glove 146 may be worn to keep the user from being burned by the vapor.

It is understood that while certain forms of this invention have been illustrated and described, it is not limited thereto except insofar as such limitations are included in the following claims and allowable functional equivalents thereof.

What is claimed is as follows:

1. A water vapor cleaning system for use with an existing plumbing system, the cleaning system comprising:

a vapor-producing chamber in communication with a water source in the existing plumbing system, said vapor-producing chamber having a vapor exit, wherein said vapor-producing chamber includes a pressure release valve to relieve excess pressure inside said vapor-producing chamber;

a nozzle having an inlet, an outlet, a valve allowing communication between said nozzle inlet and said nozzle outlet when at a first configuration and denying communication between said nozzle inlet and said nozzle outlet when at a second configuration, and an actuator for moving said nozzle valve between said first and second configurations;

tubing connecting said vapor exit to said nozzle inlet;

a vacuum device coupled to said tubing for selectively suctioning items through and blowing air out said nozzle outlet;

wherein said nozzle includes a soap reservoir that selectively dispenses soap through said nozzle outlet without said soap passing through said vapor-producing chamber;

means for dispensing water through said nozzle outlet and bypassing said vapor-producing chamber; and wherein said nozzle includes a selector device for choosing between a steaming mode, a vacuuming mode, a blowing mode, a soaping mode, and a rinsing mode.

2. The cleaning system as in claim 1, wherein:

said vacuum device is associated with said vapor-producing chamber to form a single unit;

said vacuum device and said vapor-producing chamber are installed beneath a countertop; and said tubing extends from beneath the countertop, through the countertop, and adjacent a sink basin.

3. The cleaning system as in claim 1, further comprising a safety glove to prevent injuries from vapor exiting said nozzle outlet.

4. The cleaning system as in claim 1, further comprising a plurality of accessories, each accessory being respectively attachable to said nozzle outlet to provide a unique spray characteristic.

5. The cleaning system as in claim 4, wherein at least one said accessory includes a plurality of bristles.

6. A water vapor cleaning system for use with an existing plumbing system that includes a hot water line and a sink basin installed in a countertop, the cleaning system comprising:

a vapor-producing chamber in communication with the hot water line, said vapor-producing chamber being installed beneath the countertop and having a vapor exit;

wherein said vapor-producing chamber includes a pressure release valve to relieve excess pressure inside said vapor-producing chamber;

a nozzle having an inlet, an outlet, a valve allowing communication between said nozzle inlet and said nozzle outlet when at a first configuration and denying communication between said nozzle inlet and said nozzle outlet when at a second configuration, and an actuator for moving said nozzle valve between said first and second configurations;

tubing connecting said vapor exit to said nozzle inlet, said tubing extending through the countertop and adjacent the sink basin;

a vacuum device coupled to said tubing to selectively suction items through and blow air out said nozzle outlet; and wherein said nozzle includes a selector device for choosing between a steaming mode, a vacuuming mode, and a blowing mode;

wherein said nozzle includes a soap reservoir that selectively dispenses soap through said nozzle outlet without said soap passing through said vapor-producing chamber;

wherein said nozzle selector device includes a soaping mode;

means for dispensing water through said nozzle outlet and bypassing said vapor-producing chamber;

wherein said nozzle selector device includes a rinsing mode;

a safety glove to prevent injuries from vapor exiting said nozzle outlet; and a plurality of accessories, each accessory being respectively attachable to said nozzle outlet to provide a unique spray characteristic.

* * * * *